US010070490B2

(12) United States Patent
Van Den Biggelaar et al.

(10) Patent No.: US 10,070,490 B2
(45) Date of Patent: Sep. 4, 2018

(54) LIGHT UNIT AND METHOD FOR CONTROLLING A LIGHT UNIT

(71) Applicant: PHILIPS LIGHTING HOLDING B.V., Eindhoven (NL)

(72) Inventors: Theodorus Johannes Petrus Van Den Biggelaar, Eindhoven (NL); Harald Josef Günther Radermacher, Eindhoven (NL); Peter Van Delft, Eindhoven (NL); Bob Bernardus Anthonius Theunissen, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/560,305

(22) PCT Filed: Mar. 10, 2016

(86) PCT No.: PCT/EP2016/055155

§ 371 (c)(1),
(2) Date: Sep. 21, 2017

(87) PCT Pub. No.: WO2016/150722

PCT Pub. Date: Sep. 29, 2016

(65) Prior Publication Data

US 2018/0070414 A1 Mar. 8, 2018

(30) Foreign Application Priority Data

Mar. 23, 2015 (EP) ..... 15160210

(51) Int. Cl.
*H05B 33/08* (2006.01)

(52) U.S. Cl.
CPC ..... *H05B 33/083* (2013.01); *H05B 33/0851* (2013.01)

(58) Field of Classification Search
CPC ..... H05B 37/02; H05B 37/0218; H05B 37/0227; H05B 33/08; H05B 33/0815;
(Continued)

(56) References Cited

U.S. PATENT DOCUMENTS 8,742,682 B1 * 6/2014 Wang ..... H05B 33/083 315/185 R
2013/0293122 A1 11/2013 Huynh
(Continued)

FOREIGN PATENT DOCUMENTS

WO 2012131592 A1 10/2012

OTHER PUBLICATIONS

SUPERTEX Inc., "Sequential Linear LED Driver", Doc# DSFP-CL8801, 2014.

*Primary Examiner* — Jimmy Vu

(57) ABSTRACT

A light unit (10) including one or more lighting devices, in particular one or more LEDs is disclosed. The light unit comprises input terminals (12, 14) for connecting the light unit to an external power supply (16) and for receiving an input voltage (V10) from the external power supply. A first lighting device and at least one additional lighting device (22, 24) connected in series to the input terminals and a charge storage device (26) is connected in series to the first lighting device. The first lighting device (20) and the additional lighting device (22, 24) forms a tapped linear driver that the number of the lighting device (20, 22, 24) being turned on depending on an amplitude of the input voltage (V10). The first lighting device or a second lighting device (30) is electrically connectable in parallel to the charge storage device via an additional current path (33, 52), wherein the charge storage device is adapted be switched in series with the tapped linear driver and be charged within a second time duration (t4 to t5), when the input voltage (V10) is above a threshold, and discharge when the input voltage
(Continued)

(V10) is below a certain level, to provide electrical power to the first lighting device or the second lighting device for powering the first lighting device or the second lighting device.

15 Claims, 6 Drawing Sheets

(58) Field of Classification Search
CPC ..... H05B 33/083; H05B 33/0851; H05B 33/0845; H05B 33/0857; H05B 33/0866; H05B 33/0869
USPC ..... 315/151–153, 185 R, 209 R, 291, 294, 315/307, 308, 312
See application file for complete search history.

(56) References Cited

U.S. PATENT DOCUMENTS

| | | | | |
|---|---|---|---|---|
| 2013/0313984 | A1 | 11/2013 | Maiwald | |
| 2014/0139112 | A1 | 5/2014 | Shteynberg et al. | |
| 2014/0292218 | A1 | 10/2014 | Vos | |
| 2016/0007420 | A1* | 1/2016 | Gong ..... | H05B 33/0815 315/187 |

* cited by examiner

LIGHT UNIT AND METHOD FOR CONTROLLING A LIGHT UNIT

CROSS-REFERENCE TO PRIOR APPLICATIONS

This application is the U.S. National Phase application under 35 U.S.C. § 371 of International Application No. PCT/EP2016/055155, filed on Mar. 10, 2016 which claims the benefit of European Patent Application No. 15160210.9, filed on Mar. 23, 2015. These applications are hereby incorporated by reference herein.

FIELD OF THE INVENTION

The present invention relates to a light unit including one or more lighting devices, in particular one or more LEDs. The present invention further relates to a method for driving a light unit including one or more lighting devices, in particular one or more LEDs.

BACKGROUND OF THE INVENTION

In the field of solid state light sources such as LEDs, it is commonly known to directly connect the light sources to mains voltage supply. In order to provide a stable drive current to the solid state lighting devices from the mains voltage driver units are necessary. Usually a rectified pulsating mains voltage is provided as drive voltage to the LEDs in order to power the LEDs, however, the driver devices have to ensure that the LEDs are not switched off during the zero crossing of the mains voltage to avoid that flickering light is emitted by the light unit.

In order to avoid a flicker of the emitted light, a charge capacitor is usually connected in parallel to the LEDs to provide electrical power during the zero crossing to the LEDs. Alternatively a tapped linear driver can be used, wherein also a corresponding charge capacitor is necessary in parallel to the LED units in order to provide electrical power to the LEDs during the zero crossing of the mains voltage.

The charge capacitors which provide the electrical power during the zero crossing have a large size since these charge capacitors have to be designed for high voltages around 400 V for 230 V mains voltage, so that the size of the LED unit is increased in general.

US20130313984A1 discloses a circuit for actuating a plurality of light-emitting means, wherein least one energy store is connected in parallel with a first group of light-emitting means during a charge phase, and is connected in parallel with a second group of light-emitting means during a discharges phase.

SUMMARY OF THE INVENTION

In the prior art, a current from the AC system voltage is divided into the two parallel branches of the capacitor 117/201 and tapped linear LEDs 105-109, and the current that charges the capacitor 117/201 does not flow through and drive the tapped linear LEDs 105-109. Thus the power factor is low.

It is therefore an object of the present invention to provide an improved light unit including one or more lighting devices with a higher power factor than the prior art, in particular one or more LEDs having a reduced size. Further, it is an object of the present invention to provide a corresponding method for controlling a light unit including one or more lighting devices, in particular one or more LEDs.

A basic idea of the embodiments of the invention is placing a charge storage device in series with the tapped linear driver when the charge storage device is charged, thus the same current charges the charge storage device and drives the tapped linear driver, and in turn the power factor can be improved.

According to one aspect of the present invention, a light unit including one or more lighting devices, in particular one or more LEDs is provided, comprising:

input terminals for connecting the light unit to an external power supply and for receiving an input voltage from the external power supply, a first lighting device and at least one additional lighting device electrically in series connected to the input terminals, the first lighting device and the additional lighting device forming a tapped linear driver that the number of the lighting devices being turned on depending on an amplitude of the input voltage, and a charge storage device electrically connected in series to the tapped linear driver, wherein the first lighting device and/or a second lighting device is electrically connectable in parallel to the charge storage device via an additional current path and wherein the charge storage device is adapted to be switched in series with the tapped linear driver and be charged within a second time duration when the input voltage is above a threshold, and discharge when the input voltage is below a certain level, to provide electrical power to the first lighting device and/or the second lighting device for powering the first lighting device and/or the second lighting device.

According to another aspect of the present invention, a method for controlling a light unit including one or more lighting devices, in particular one or more LEDs is provided, comprising the steps of:

providing an input voltage from an external power supply to input terminals, providing the input voltage to a first lighting device and at least one additional lighting device electrically connected in series and forming a tapped linear driver that the number of the lighting devices being turned on depending on an amplitude of the input voltage, and to a charge storage device connected in series to the tapped linear driver, connecting the first lighting device and/or a second lighting device in parallel to the charge storage device via an additional current path, and switching charge storage device to:

be switched in series with the tapped linear driver and be charged within a second time duration when the input voltage is above the threshold, and discharge when the input voltage is below a certain level, to provide electrical power from the charge storage device to the first lighting device and/or the second lighting device.

Preferred embodiments of the invention are defined in the dependent claims. It shall be understood that the claimed method has similar and/or identical preferred embodiments as the claimed device and as defined in the dependent claims.

The present invention is based on the idea to connect the light emitting device namely the tapped linear driver in series to a charge storage device so that during one half cycle of the mains voltage the charge storage device can be charged at the same time the tapped linear driver is driven via the same current, and to connect the first lighting device and/or a second lighting device via an additional current path in parallel to the charge storage device so that the electrical power stored in the charge storage device can be utilized during or close to the zero crossing of the mains voltage to power the second lighting device and that a switch off of the light unit in general can be avoided. The additional current path is formed in addition to the series connection of the first lighting device and the charge storage device and preferably in parallel to the series connection. The electrical power is stored or collected during one half cycle of the mains voltage, when the mains voltage is above a certain voltage level and utilized to power the first or the second lighting device when the mains voltage is close to the zero crossing or below a certain voltage level. Hence, a flickering of the emitted light can be reduced, since at least one lighting device is powered at each time of the mains voltage cycle. Further, since the charge storage device is in series with the tapped linear driver within the second time duration, the current from the external power supply both charges the charge storage device and drives the LEDs in the tapped linear driver, the power factor of the light unit is increased.

Since the charge storage device can be adapted to a reduced voltage difference between the input voltage and the dropping across the first lighting device and/or a string of lighting devices, the charge storage device can be designed for low voltages and a small charge storage device can be utilized so that the overall size of the light unit can be reduced. Further, the use of an electrolytic capacitor can be avoided so that the overall lifetime can be improved.

In a preferred embodiment, a diode is connected in series between the charge storage device and the tapped linear driver. This is a possibility to avoid a charge loss of the charge storage device when the input voltage is below a certain voltage level close to the zero crossing. Inherently, since the charge storage device and drive the tapped linear driver are switched in series, the input voltage provides the same current to charge the charge storage device and drive the tapped linear driver when the charge storage device is switched in series with the tapped linear driver.

In a preferred embodiment, the charge storage device is connected via a second diode to the first lighting device. This is a possibility to charge the charge storage device via the first lighting device when the input voltage is above a certain voltage level and to discharge the charge storage device via the first lighting device when the input voltage is below a certain level.

In a preferred embodiment, a first current control device is connected in parallel to the charge storage device for controlling an electrical current provided to the charge storage device, wherein the first current control device is adapted to bypass the charge storage device to allow the tapped linear driver being driven by the input voltage, when the input voltage increases until the threshold. This is a possibility to precisely charge the charge storage device when the input voltage is above a predefined voltage level.

In a preferred embodiment, a second current control device is connected in series to the second lighting device for controlling the electrical power provided to the second lighting device. This is a possibility to activate the second lighting device in a predefined manner so that a switch off and a corresponding flickering of the light emitted by the light unit can be avoided.

In a preferred embodiment, the current control devices are controllable switches. This is a possibility to control the light emission of the second lighting device and the charging of the charge storage device with low technical effort.

In a further preferred embodiment, a control unit is connected to the second current control device for controlling the current control device dependent on the input voltage. This is a possibility to determine a certain voltage level at which a switch off of the first lighting device can be expected so that the second lighting device can be activated close to the zero crossing of the mains voltage when the mains voltage is below a critical voltage level. Hence, a precise control of the second lighting device can be achieved.

In a further embodiment, a light sensor is associated to the first lighting device, wherein the second current control device connected to the light sensor and is controlled dependent on the light emitted by the first lighting device detected by the light sensor, wherein the second current control device is switched off on the basis of the detected light from the connected light sensor. This is a possibility to activate the second lighting device dependent on the light emission of the first lighting device so that the second lighting device can be activated when the first lighting device is switched off due to a reduced voltage level close to the zero crossing of the mains voltage, and activated when the first lighting device is switched on when the voltage increases. This is a possibility to precisely control the second lighting device with low technical effort and to avoid a flickering of the light emitted by the light unit in general.

In a preferred embodiment, one additional current control device is associated to the additional lighting device for controlling the additional lighting device. This is a possibility to provide a driver unit by means of which a plurality of lighting devices can be precisely controlled during the cycles of the mains voltage.

In a preferred embodiment, the additional current control device is connected to a node between two of the lighting devices and one of the input terminals. This is a possibility to provide a tapped linear driver for the light unit in order to drive the different lighting devices individually.

In a preferred embodiment, the additional current control device is connected in parallel to the additional lighting device. This is a possibility to individually activate or deactivate the additional lighting device independently.

In a preferred embodiment, the additional current control device is connected in parallel to the additional lighting device and the charge storage device. This is an alternative possibility to individually activate the lighting devices dependent on the input voltage.

In a preferred embodiment, wherein a light sensor is associated to each of the lighting devices connected in series to each other, and wherein the light sensor associated to the first lighting device is connected to one of the additional current control device for controlling the one additional current control device on the basis of the detected light of the first lighting device; the light sensor associated to one of the additional lighting device is connected to another of the additional current control device for controlling the another additional current control device on the basis of the detected light of the one additional lighting device; and the light sensor associated to another of the additional lighting device is connected to the first current control device for controlling the first current control device on the basis of the detected light of the another additional lighting device.

An advantage of this embodiment is providing a circuit structure for controlling the current control devices in the tapped linear driver as well as of the charge storage device.

In a preferred embodiment, the additional current control devices are each connected in parallel to one of the additional lighting devices, respectively. This is a possibility to individually control the additional lighting devices with low technical effort.

In a preferred embodiment, the additional current control devices are each connected in parallel to one of the additional lighting devices, respectively, and in parallel to the second lighting device. This is an alternative possibility to provide a tapped linear driver and to control the different lighting devices individually.

In a further embodiment, the current control device are switched off on the basis of the detected light from the connected light sensor. This embodiment provides a specific way of controlling the tapped linear driver and the charging of the charge storage device: when the light emitted from the previous lighting device in the tapped linear driver is high enough, a next lighting device in the tapped linear driver is activated automatically. Further, when the last lighting device in the tapped linear driver emit sufficient light which means the input voltage is high enough, the charge storage device will be switched in series with the tapped linear driver and be charged.

In a preferred embodiment, the charge storage device is a charge capacitor. This is a possibility to further reduce the technical effort of the light unit.

In a preferred embodiment, the second current control device is controlled dependent on the light emitted by the one additional lighting device and detected by the light sensor, not dependent on the light emitted by the first lighting device and detected by the light sensor, wherein the second current control device is switched off on the basis of the detected light from the connected light sensor. In this embodiment, when the additional lighting device in tapped linear is driven by the input voltage, it will automatically switches off the charge storage device from powering the lighting device; otherwise when the additional lighting device in tapped linear is switched off, the charge storage device powers the lighting device, thus the overall light output of the light unit is preciously controlled.

The capacity and the voltage of the charge capacitor are dependent on the length of the string of LEDs.

In a preferred embodiment, the lighting devices are light emitting diodes. This is a possibility to further reduce the technical effort of the light unit and to reduce the power consumption of the light unit in general.

In a preferred embodiment, the charge storage device is electrically connected in series to a cathode side of the first lighting device and electrically connected to an anode of the first lighting device via the additional current path, and the charge storage device is sized to be charged, within the second time duration, to a level that is sufficient to power the first lighting device. This is a possibility to charge and discharge the charge storage device via the first lighting device.

Alternatively or additional to powering the first lighting device, in a preferred embodiment, the second lighting device is connectable in parallel to the charge storage device via a second current control device in another of the additional current path, and the charge storage device is sized to be charged, within the second time duration, to a level that is sufficient to power the second lighting device. This is a possibility to provide the stored electrical power independently to the different lighting devices, so that the different lighting devices can be powered during different time frames.

As mentioned above by means of the present light unit a flickering of the emitted light can be avoided, since the electrical power can be stored in the charge storage device during a cycle of the mains voltage when the mains voltage is above a certain voltage level and the so stored electrical power can be utilized to power the first and/or the second lighting device when the mains voltage drops below a certain voltage level close to the zero crossing. Hence, in each case at least one lighting device is activated and the light unit can emit continuously light even if the input voltage drops below a certain voltage level close to the zero crossing. Since the charge storage device can be adapted to the voltage level necessary to activate the first or the second lighting device which are connectable in parallel to the charge storage device, the charge storage device can be designed for low voltages so that the overall size of the light unit and the corresponding technical effort can be reduced. Further, since when the charge storage device is charged, the charging current also flows through and drives the tapped linear driver, thus the power factor is high.

These and other aspects of the invention will be apparent from and elucidated with reference to the embodiment(s) described hereinafter.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
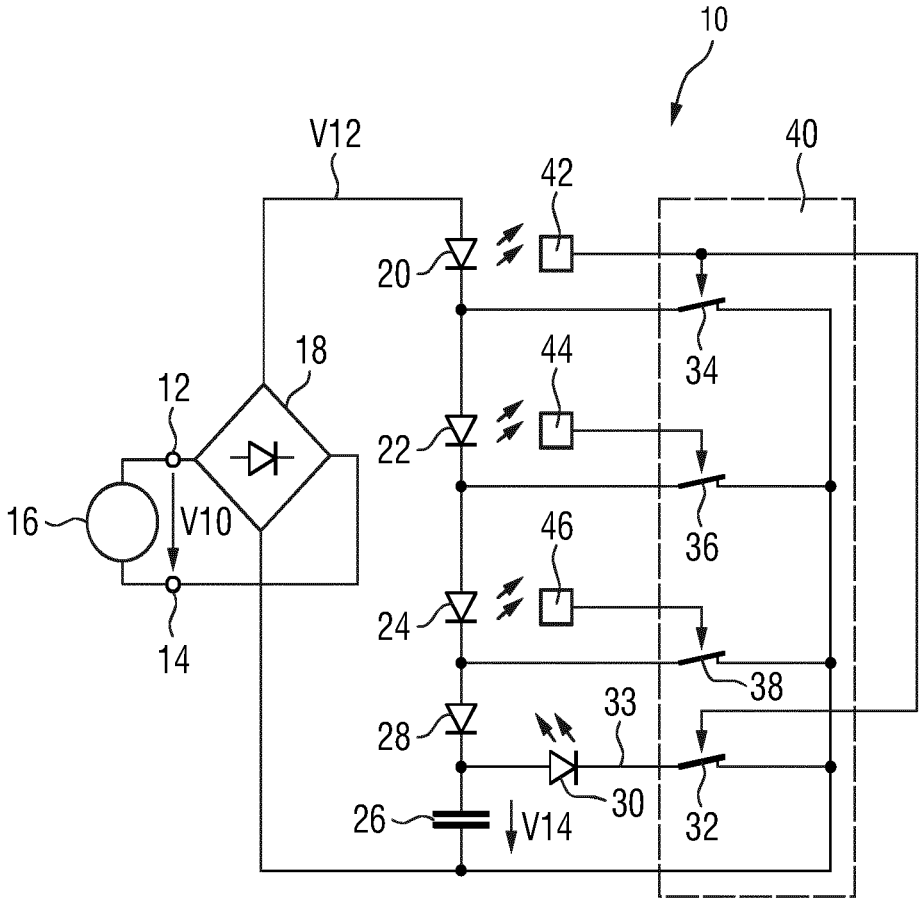
FIG. 1 shows a schematic block diagram of a light unit including a plurality of LEDs and a tapped linear driver.

FIG. 1 shows a schematic block diagram of a light unit generally denoted by 10. The light unit 10 comprises input terminals 12, 14 for connecting the light unit 10 to an external voltage supply 16 which is preferably mains and supplies an input voltage V10 which is preferably mains voltage. Alternatively, the voltage supply 16 can provide a triangle voltage or a saw tooth voltage or the like. The light unit 10 comprises a rectifier 18 connected to the input terminals 12, 14 for rectifying the alternating input voltage V10 to a rectified voltage V12.

The light unit 10 comprises a plurality of light emitting diodes 20, 22, 24 which are connected in a forward direction in series to each other and connected in series to the rectifier 18 in order to receive the rectified voltage V12. The light unit 10 further comprises a charge capacitor 26 and a diode 28 which are connected in series to each other and in series to the light emitting diodes 20, 22, 24. The charges capacitor 26 and the diode 28 are connected to a cathode side of the string of light emitting diodes 20, 22, 24. The light unit 10 further comprises a light emitting diode 30 which is connected to a controllable switch 32 and which is connectable in parallel to the charge capacitor 26 by means of the controllable switch 32. The light emitting diode 30 and the controllable switch 32 form an additional current path 33 to discharge the charge capacitor 26.

The light unit 10 further comprises a plurality of controllable switches 34, 36, 38 which are each connected to a node or a tap between the light emitting diodes 20, 22, 24, 30 and to the rectifier 18 in order to form a tapped linear driver 40 for the light emitting diodes 20, 22, 24, 30 in order to activate and deactivate the respective light emitting diodes 20, 22, 24, 30 individually. The tapped linear driver 40 is connected to light detectors 42, 44, 46, which are respectively associated to one of the light emitting diodes 20, 22, 24, in order to detect a light emitted by the light emitting diodes 20, 22, 24, and to provide a corresponding light signal or drive signal to control the controllable switches 34, 36, 38, 32 on the basis of the light emitted by the respective light emitting diode 20, 22, 24. The tapped linear driver 40 is therefore optical controlled and preferably formed as an optical controlled tapped linear driver.

During one half cycle of the mains voltage V10 which is provided as the rectified voltage V12 to the light emitting diodes 20, 22, 24, the light emitting diode 20 is switched on when a certain voltage level corresponding to the forward voltage of the light emitting diode 20 is reached by the rectified voltage V12 and the controllable switch 34 is switched off on the basis of the light signal received from the light sensor 42. Hence, the diode 22 is activated or connected to the input terminals 12, 14 and switched on when the voltage drop across the light emitting diode 22 reaches the forward voltage and correspondingly the controllable switch 36 is switched off by means of the light signal received from the light sensor 44. As a consequence, the light emitting diode 24 is activated or connected to the input terminals 12, 14 and switched on when the voltage drop across the light emitting diode 22 reaches the forward voltage and the controllable switch 38 is switched off by means of the light signal received from the light sensor 46. Hence, the light emitting diodes 20, 22, 24 are successively switched on in a cascade or step by step when the rectified voltage V12 increases and after the light emitting diode 24 is switched on, the charge capacitor 26 is connected to the rectifier 18 so that the charge capacitor 26 is charged. When the rectified voltage V12 decreases during the half cycle and the light emitting diode 24 is switched off due to the decrease of the rectified voltage V12, the controllable switch 38 is closed so that the charge capacitor 26 is again disconnected from the rectifier 18. While the rectified voltage V12 decreases, the light emitting diodes 20, 22, 24 are successively switched off step by step.

When the light emitting diode 20 is switched off, the controllable switch 32 is closed on the basis of the light signal received from the light sensor 42 so that the light emitting diode 30 is connected in parallel to the charged charge capacitor 26 and correspondingly powered and switched on. Hence, the light emitting diode 30 is powered during the time frame close to the zero crossing of the mains voltage V10 so that the light unit 10 continuously emits light and a flickering of the emitted light can be avoided. When the rectified voltage V12 increases again and the light emitting diode 20 is switched on, the controllable switch 32 is switched off in order to deactivate the light emitting diode 30. The light emitting diode 30 can be designed for low voltages, since the light emitting diode 30 is not connected in series to the string of light emitting diodes 20, 22, 24 and the charge capacitor 26 can be correspondingly designed for low voltages since it is connected in series to the light emitting diodes and can be adapted to the electrical characteristics of the light emitting diode 30.

In an alternative embodiment, the tapped linear driver 40 comprises a voltage measurement unit for measuring the rectified voltage V12, wherein the tapped linear driver 40 switches the controllable switches 32, 34, 36, 38 correspondingly on the basis of the measured rectified voltage V12.

In an alternative embodiment, the tapped linear driver 40 comprises a current measurement unit for measuring the rectified current, wherein the tapped linear driver 40 switches the controllable switches 32, 34, 36, 38 correspondingly on the basis of the measured rectified current.

Figure 2:
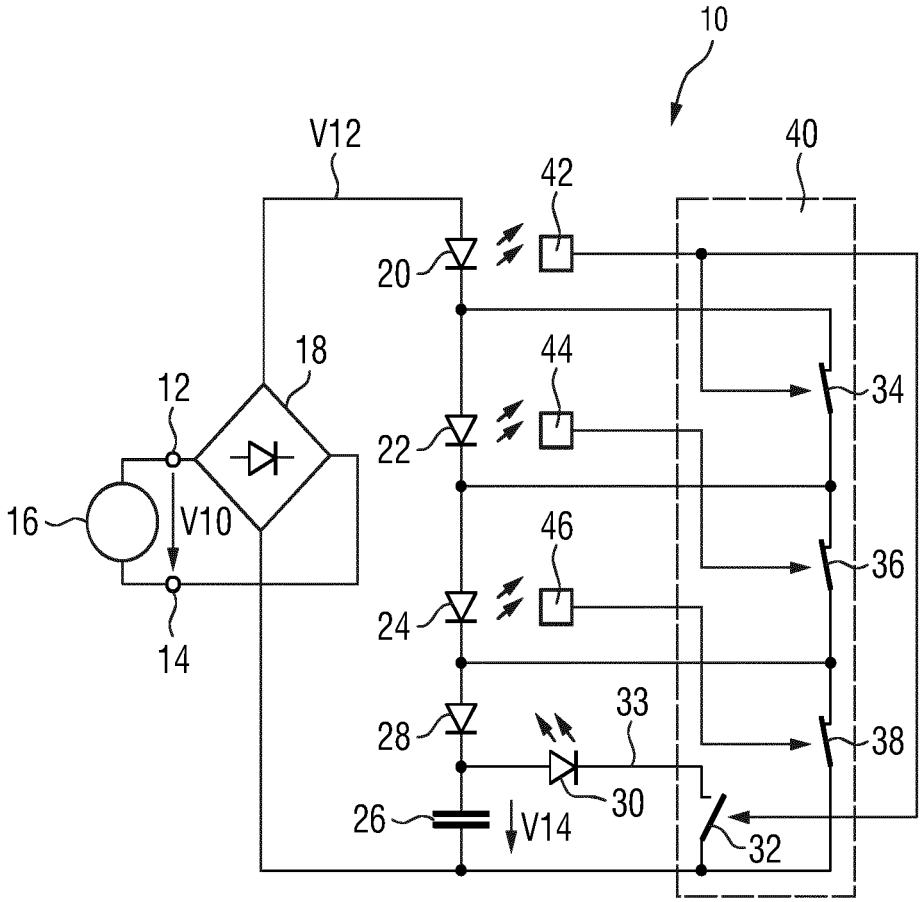
FIG. 2 shows a schematic block diagram of a light unit including a plurality of LEDs and an alternative tapped linear driver.

FIG. 2 shows a block diagram of an alternative embodiment of the light unit 10 including the tapped linear driver 40. Identical elements are denoted by identical reference numerals, wherein here merely the differences are explained in detail.

The controllable switches 34, 36, 38 are in this embodiment of the tapped linear driver 40 connected in series to each other and respectively connected in parallel to one of the light emitting diodes 22, 24, 30 in order to individually activate or deactivate the respective light emitting diode 22, 24 and to charge the charge capacitor 26.

The tapped linear driver 40 comprises the light sensors 42, 44, 46 associated to the light emitting diodes 20, 22, 24 as explained above in order to activate and deactivate the controllable switches 32, 34, 36, 38 and to connect the respective light emitting diodes 22, 24 and the charge capacitor 26 to the input terminals 12, 14 or the rectifier 18 and to activate the light emitting diode 30 when the light emitting diode 20 is switched off as explained above.

In an alternative embodiment, the tapped linear driver 40 comprises a voltage measurement unit for measuring the rectified voltage V12 and to control the controllable switches 32, 34, 36, 38 on the basis of the rectified voltage V12.

In an alternative embodiment, the tapped linear driver 40 comprises a current measurement unit for measuring the rectified current and to control the controllable switches 32, 34, 36, 38 on the basis of the rectified current.

Figure 3:
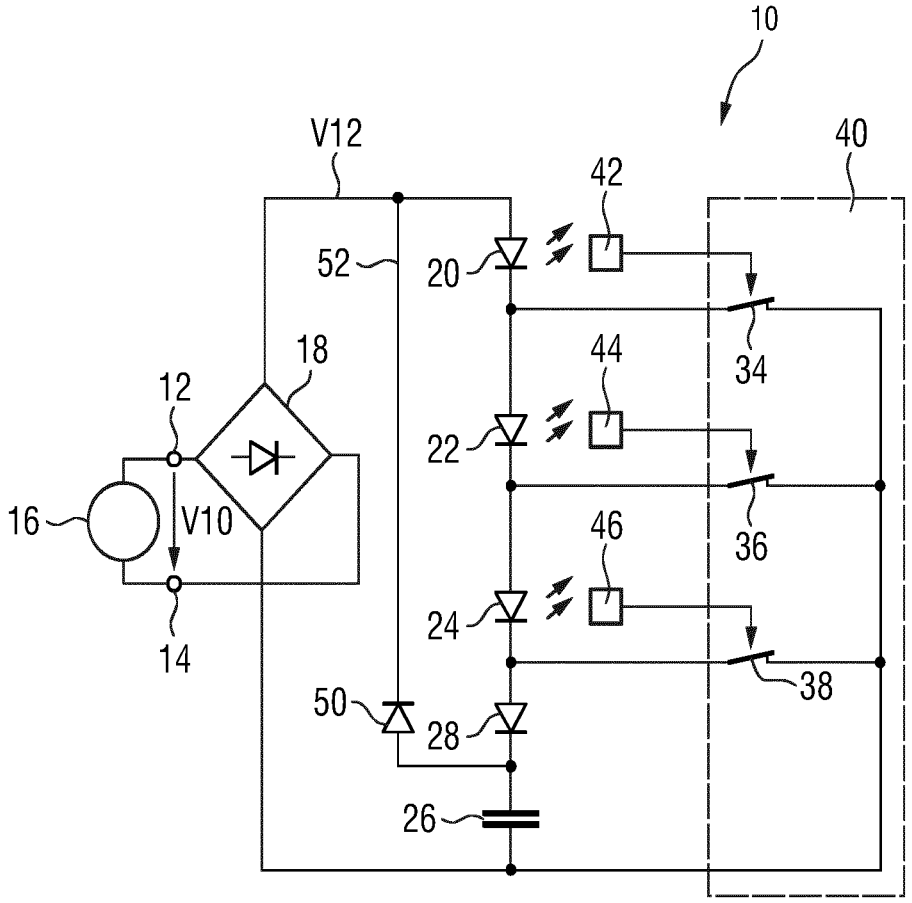
FIG. 3 shows a schematic block diagram of an alternative embodiment of a light unit including a plurality of LEDs.

FIG. 3 shows a schematic block diagram of an alternative embodiment of the light unit 10 including a different additional current path. Identical elements are denoted by identical reference numerals, wherein here merely the differences are explained in detail.

The charge capacitor 30 is connected via a diode 50 to an anode side or anode contact of the light emitting diode 20, wherein the electrical connection including the diode 50 forms an additional current path 52 for discharging the charge capacitor 26 as described in the following. The additional current path 52 is in general connected in parallel to the string of light emitting diodes 20, 22, 24 and the diode 28, wherein the forward direction of the diode 50 is directed in an opposite direction of the light emitting diode 20, 22, 24 and the diode 28.

When the rectified voltage V12 drops below a certain voltage level and the controllable switch 34 is closed or switched on so that the diodes 22, 24 are deactivated or disconnected from the input terminals 12, 14, the current path 52 for discharging the charge capacitor 26 is formed via the diode 50, the light emitting diode 20 and the controllable switch 34 so that the light emitting diode 20 is connected in parallel to the charge capacitor 26 via the additional current path 52. Hence, the electrical power stored in the charge capacitor 26 can be discharged via the light emitting diode 20 in order to power the light emitting diode 20 and to provide a corresponding light emission. By means of this additional current path 52, the switch off of the light unit 10 and a corresponding flicker can be avoided close to the zero crossing of the input voltage V10.

Figure 4:
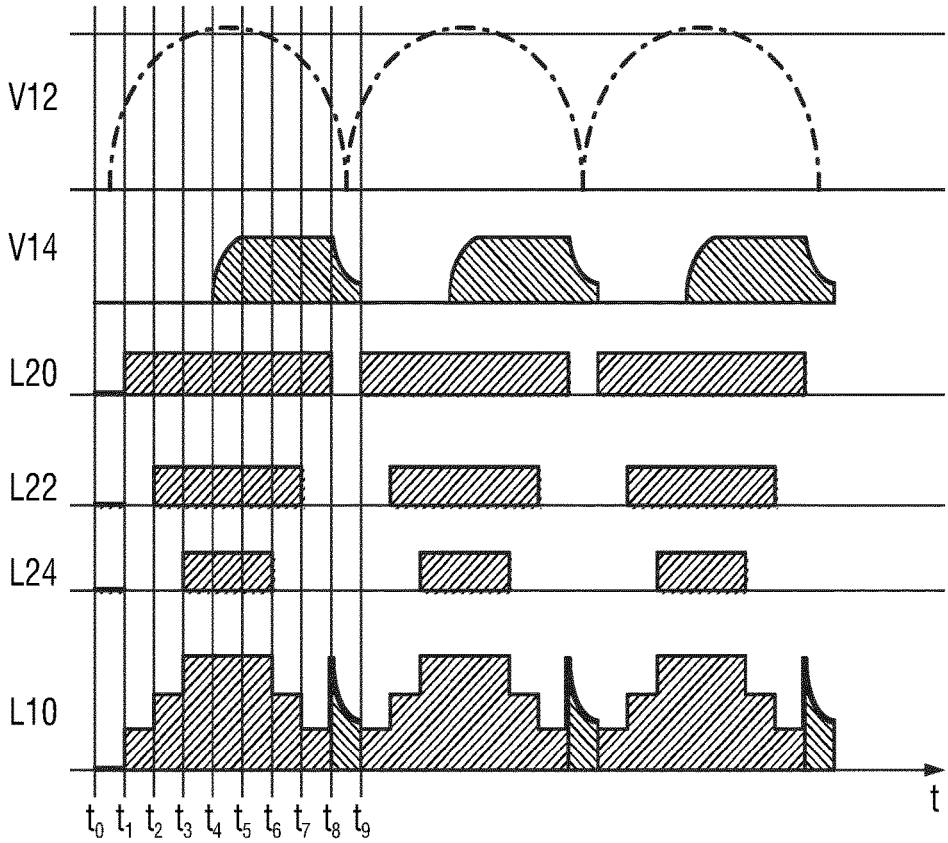
FIG. 4 shows a timing diagram illustrating the input voltage and the light output of the LEDs of the light units shown in FIGS. 1, 2 and 3.

FIG. 4 shows a timing diagram of the rectified voltage V12, a charge capacitor voltage V14 dropping across the charge capacitor 26, the light output L20, L22, L24 of the light emitting diodes 20, 22, 24 and the total light output L10 of the light unit 10.

The rectified voltage V12 has a rectified or unipolar sinusoidal waveform and drops during each zero crossing of the mains voltage down to zero. During each of cycle of the mains voltage V10, the rectified voltage V12 increases until a certain threshold level corresponding to the forward voltage of the light emitting diode 20 is reached at $t_1$ so that the light emitting diode 20 is switched on. At a further increased threshold level at $t_2$ the light emitting diode 22 is switched on and at a further increased threshold level at $t_3$, the light emitting diode 24 is switched on. At $t_4$, the controllable switch 38 is opened so that the charge capacitor 26 is electrically connected to the rectifier 18 and correspondingly charged so that the charge capacitor voltage V14 increases as shown in FIG. 4. At $t_5$, the controllable switch 38 is closed so that the charge capacitor 26 is electrically disconnected from the rectifier 18 after the charge capacitor 26 has been charged. At $t_6$, the controllable switch 36 is closed so that the light emitting diode 24 is disconnected from the rectifier 18, at $t_7$, the controllable switch 34 is closed so that the light emitting diode 22 is disconnected from the rectifier 18 and at $t_8$, the rectified voltage V12 drops below the forward voltage of the light emitting diode 20, so that the light emitting diode 20 is switched off.

According to the embodiments of FIGS. 1 and 2 at $t_8$, the controllable switch 32 is closed so that the charge capacitor 26 is discharged via the light emitting diode 30 as shown by V14 and the light emitting diode 30 is switched on and emits correspondingly light as shown by L10 in FIG. 4. At $t_9$, when the rectified voltage V12 reaches the threshold level of light emitting diode 20 again, the light emitting diode 20 is switched on. As a consequence, the controllable switch 32 is opened again so that the light emitting diode 30 is switched off.

According to the embodiment of FIG. 3, at $t_8$, when the rectified voltage V12 drops below the forward voltage of the light emitting diode 20, the electrical power or electrical charge stored in the charge capacitor 26 is discharged via the additional current path 52 and the diode 50 and correspondingly via the light emitting diode 20 and the controllable switch 34 so that the light emitting diode 20 is powered between $t_8$ and $t_9$ by the charge capacitor 26 and emits correspondingly light. Hence, a switch off of the light unit 10 between $t_8$ and $t_9$ when the rectified voltage V12 is close to the zero crossing can be avoided. By means of the diode 50 which is directed in the opposite direction than the light emitting diodes 20, 22, 24 and the diode 28, the light emitting diode 20 is connected or connectable via the controllable switch 34 in parallel to the charge capacitor 26 so that the light emitting diode 20 can be separately powered by means of the electrical charge stored in the charge capacitor 26.

Hence, during the time frame between $t_8$ and $t_9$ when the light emitting diodes 20, 22, 24 are switched off due to the low rectified voltage V12 close to the zero crossing, the charge capacitor 26 is discharged via the light emitting diode 20 or the light emitting diode 30 and the light emitting diode 20 or the light emitting diode 30 correspondingly emits light. Hence, a switch off of the light unit 10 close to the zero crossing of the mains voltage V10 can be avoided as illustrated by the light emission L10 of the light unit 10 shown in FIG. 4.

Figure 5:
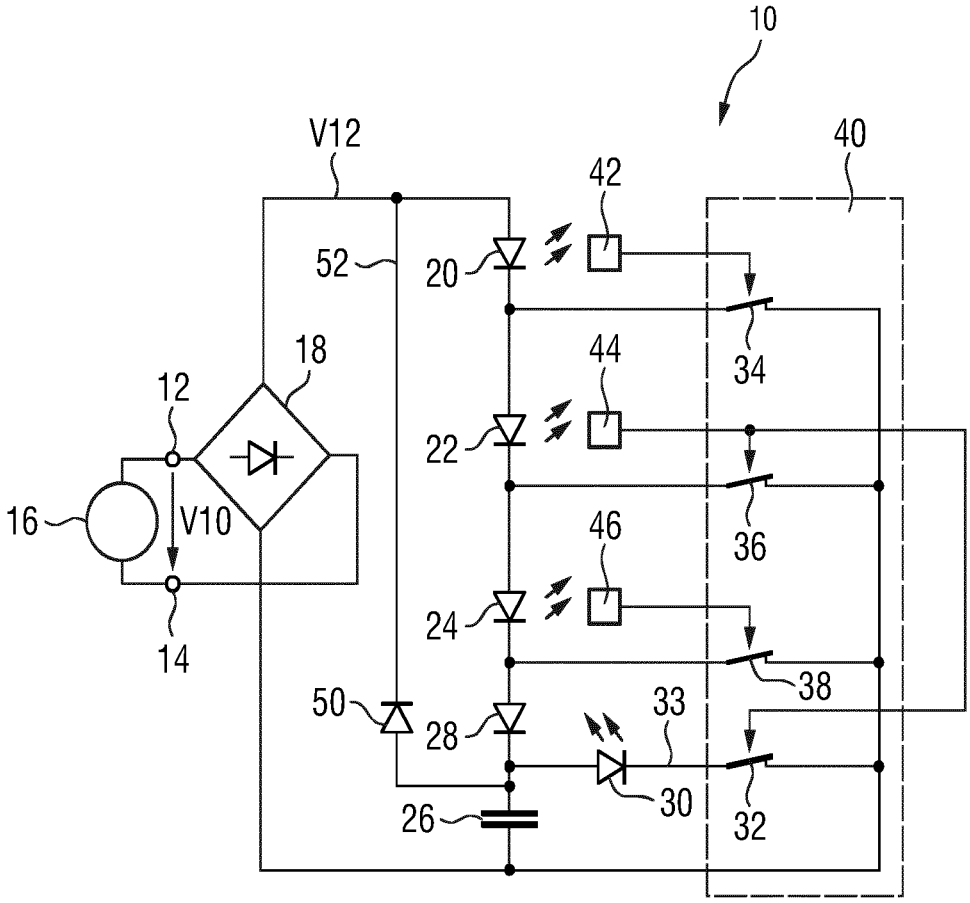
FIG. 5 shows a schematic block diagram of a further embodiment of a light unit including a plurality of LEDs and a tapped linear driver.

FIG. 5 shows a schematic block diagram of a further embodiment of the light unit 10 including a plurality of LEDs and a tapped linear driver. Identical elements are denoted by identical reference numerals, wherein here merely the differences are described in detail.

The light unit 10 comprises the additional current path 33 shown in FIGS. 1 and 2 comprising the light emitting diode 30 which is connectable in parallel to the charge capacitor 26 by means of the controllable switch 32. The controllable switch 32 is connected to the light sensor 44, which is associated to the light emitting diode 22, so that the controllable switch 32 is closed when the light emitting diode 22 is switched off. The light unit 10 further comprises the additional current path 52 shown in FIG. 3 by means of which the light emitting diode 20 is connectable via the controllable switch 34 in parallel to the charge capacitor 26 in order to power the light emitting diode 20.

Hence, the light unit 10 shown in FIG. 5 is a combination of the light units shown in FIGS. 1 and 3, wherein the light emitting diodes 20 and 30 can be individually powered by means of the charge capacitor 26 during certain time frames of the half cycle of the input voltage V10 as described in the following.

The light emitting diode 30 is connected in parallel to the charge capacitor 26 by means of the controllable switch 32, wherein the controllable switch 32 can be closed at a time when light emitting diode 22 is switched off. The light emitting diode 30 is switched on at this moment. When V12 drops further, current path 52 will be activated, so the light emitting diode 20 and 30 are both switched on and are powered by the charge capacitor 26 close to the zero crossing of the input voltage V10 and the switch off of the light unit 10 can be avoided.

Figure 6:
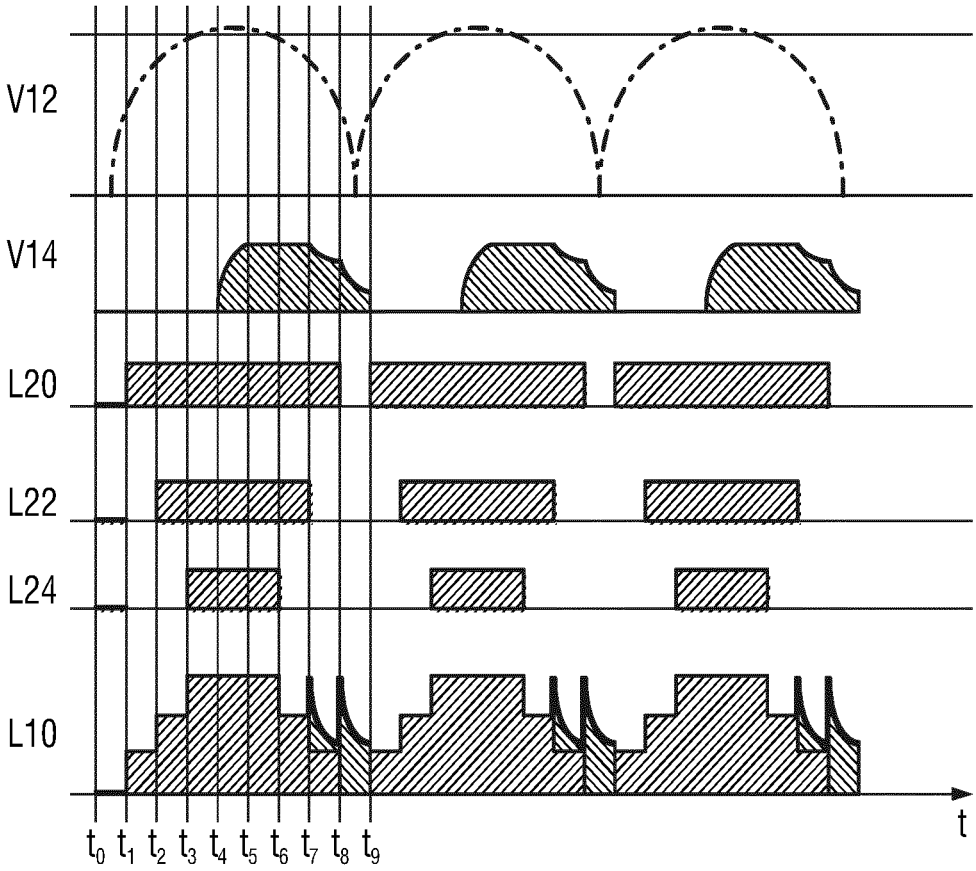
FIG. 6 shows a timing diagram illustrating the input voltage and the light output of the LEDs of the light units shown in FIG. 5.

FIG. 6 shows a timing diagram illustrating the rectified voltage V12 and the light output of the LEDs of the light unit 10 shown in FIG. 5. The time diagram in general corresponds to the time diagram of FIG. 4, wherein merely the differences are explained in detail.

At $t_7$, when the light emitting diode 22 is disconnected from the input terminals 12, 14 and when merely the light emitting diode 20 is powered by means of the rectified voltage V12, the controllable switch 32 is closed so that the charge capacitor 26 is discharged via the light emitting diode 30 and powers the light emitting diode 30 correspondingly. As shown by light emission L10 of the light unit 10 shown in FIG. 6 an additional light peak is provided by the light unit 10.

At $t_8$, when the rectified voltage V12 drops below the forward voltage of the light emitting diode 20 and the controllable switch 34 is closed, the light emitting diode 20 is powered by the charge capacitor 26 via the current path 52. Also controllable switch 32 is closed at this moment. Hence, the light emitting diode 20 and 30 emits light close to the zero crossing of the input voltage V10 as shown by L10 of FIG. 6 so that a switch off of the light unit can be avoided.

Since the charge capacitor 26 is connected in series to the light emitting diodes 20, 22, 24 and individually designed to drive light emitting diode 20 and 30, the charge capacitor 26 can be provided having a reduced voltage and a reduced size so that the size and the technical effort of the light unit in general can be reduced.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. Light unit including one or more lighting devices, in particular one or more LEDs, comprising:

input terminals for connecting the light unit to an external power supply and for receiving an input voltage from the external power supply, a first lighting device and at least one additional lighting device electrically connected in series to the input terminals, the first lighting device and the additional lighting device forming a tapped linear driver that the number of the lighting devices being turned on depending on an amplitude of the input voltage, and a charge storage device electrically connected in series to the tapped linear driver, wherein a second lighting device is electrically connectable in parallel to the charge storage device via an additional current path and wherein the charge storage device is adapted to:

be switched in series with the tapped linear driver and be charged within a second time duration ($t_4$ to $t_5$), when the input voltage is above a threshold, and discharge when the input voltage is below a certain level, to provide electrical power to the second lighting device for powering the second lighting device;

the light unit further comprises:

a second current control device is connected in series to the second lighting device for controlling the electrical power provided to the second lighting device; and a light sensor associated to any one of the first lighting device and the at least one additional lighting device, wherein the second current control device is connected to the light sensor and controlled dependent on the light emitted by any one of the first lighting device and the at least one additional lighting device and detected by the light sensor, wherein the second current control device is switched off on the basis of the detected light from the light sensor.

2. Light unit as claimed in claim 1, wherein a diode is connected in series between the charge storage device and the tapped linear driver, and thereby the input voltage provides the same current to charge the charge storage device and drive the tapped linear driver when the charge storage device is switched in series with the tapped linear driver.

3. Light unit as claimed in claim 1, wherein the charge storage device is connected via a second diode to the first lighting device.

4. Light unit as claimed in claim 1, wherein a first current control device is connected in parallel to the charge storage device for controlling an electrical current provided to the charge storage device, when the input voltage increases until the threshold the first current control device is adapted to bypass the charge storage device to allow the tapped linear driver being driven by the input voltage.

5. Light unit as claimed in claim 1, wherein the first lighting device is electrically connectable in parallel to the charge storage device via an additional current path and wherein the charge storage device is adapted to:

discharge when the input voltage is below a certain level, to provide electrical power to the first lighting device for powering the first lighting device.

6. Light unit as claimed in claim 5, wherein one additional current control device is associated to the additional lighting device for controlling the additional lighting device.

7. Light unit as claimed in claim 6, wherein the additional current control device is connected to a node between two of the lighting devices and one of the input terminals.

8. Light unit as claimed in claim 6, wherein the additional current control device is connected in parallel to the additional lighting device.

9. Light unit as claimed in claim 6, wherein the additional current control device is connected in parallel to the additional lighting device and the charge storage device.

10. Light unit as claimed in claim 1, wherein the light sensor is associated to each of the lighting devices connected in series to each other, and wherein the light sensor associated to the first lighting device is connected to one of the additional current control device connected in parallel to one of the additional lighting device, for controlling the one additional current control device on the basis of the detected light of the first lighting device;

the light sensor associated to one of the additional lighting device is connected to another of the additional current control device connected in parallel to another of the additional lighting device for controlling the another additional current control device on the basis of the detected light of the one additional lighting device.

11. Light unit as claimed in claim 10, wherein each of the current control device is switched off on the basis of the detected light from the light sensor connected to the respective current control device.

12. Light unit as claimed in claim 1, wherein the second current control device is controlled dependent on the light emitted by the one additional lighting device and detected by the light sensor associated to one of the additional lighting device, not dependent on the light emitted by the first lighting device and detected by the light sensor associated to the first lighting device, wherein the second current control device is switched off on the basis of the detected light from the light sensor associated to one of the additional lighting device.

13. Light unit as claimed in claim 1, wherein the lighting devices are formed as light emitting diodes and wherein the charge storage device is electrically connected in series to a cathode side of the first lighting device and electrically connected to an anode of the first lighting device via one of the additional current path, and the charge storage device is sized to be charged, within the second time duration, to a level that is sufficient to power the first lighting device.

14. Light unit as claimed in claim 1, wherein the second lighting device is connectable in parallel to the charge storage device via a second current control device in another of the additional current path, and the charge storage device is sized to be charged, within the second time duration, to a level that is sufficient to power the second lighting device.

15. Light unit as claimed in claim 1, wherein a first current control device is connected in parallel to the charge storage device for controlling an electrical current provided to the charge storage device, wherein the first current control device is adapted to bypass the charge storage device to allow the tapped linear driver being driven by the input voltage, when the input voltage increases until the threshold; and the light sensor associated to another of the additional lighting device is connected to the first current control device for controlling the first current control device on the basis of the detected light of the another additional lighting device.

* * * * *